US006729665B1

(12) United States Patent
Posey et al.

(10) Patent No.: US 6,729,665 B1
(45) Date of Patent: May 4, 2004

(54) ADJUSTABLE POURING HANDLE

(76) Inventors: Albert E. Posey, 533 W. Hwy. 54, Hermitage, MO (US) 65668; Madelin C. Posey, 533 W. Hwy. 54, Hermitage, MO (US) 65668

( * ) Notice: Subject to any disclaimer, the term of this patent is extended or adjusted under 35 U.S.C. 154(b) by 0 days.

(21) Appl. No.: 10/321,102

(22) Filed: Dec. 17, 2002

(51) Int. Cl.[7] ..... B65D 23/10
(52) U.S. Cl. ..... 294/31.2; 215/396; 294/154
(58) Field of Search ..... 294/27.1, 31.2, 294/150, 153, 154, 157, 165; 215/396; 16/425

(56) References Cited

U.S. PATENT DOCUMENTS

| | | | | | |
|---|---|---|---|---|---|
| 622,862 | A | * | 4/1899 | Pierce | 294/31.2 |
| 3,012,809 | A | * | 12/1961 | Tremaine | 294/31.2 |
| 3,073,493 | A | * | 1/1963 | Pfaffenberger | 294/154 |
| 3,794,370 | A | * | 2/1974 | Lockhart et al. | 294/31.2 |
| 3,844,459 | A | * | 10/1974 | Chambers | 224/274 |
| 4,379,578 | A | | 4/1983 | Schuler | |
| 4,656,566 | A | * | 4/1987 | Kelley | 362/202 |
| 4,660,876 | A | | 4/1987 | Weldin et al. | |
| 4,667,359 | A | * | 5/1987 | Polotti | 7/151 |
| 4,741,073 | A | * | 5/1988 | Capen | 16/425 |
| 4,768,403 | A | | 9/1988 | Bar-Noy | |
| 4,842,158 | A | * | 6/1989 | Reyes, Jr. | 222/470 |
| 5,104,010 | A | | 4/1992 | Codorniz et al. | |
| 5,348,362 | A | * | 9/1994 | Rolls | 294/151 |
| 5,353,819 | A | | 10/1994 | Kahn et al. | |
| 5,934,296 | A | | 8/1999 | Clay | |
| 6,105,831 | A | | 8/2000 | Finezilber | |
| 6,135,310 | A | | 10/2000 | Svehaug | |
| 6,237,818 | B1 | | 5/2001 | Kline | |

* cited by examiner

*Primary Examiner*—Dean J. Kramer
(74) *Attorney, Agent, or Firm*—John D. Gugliotta; Olen L. York, III

(57) ABSTRACT

An adjustable pouring handle is a linearly elongated body having a pair of adjustable container straps that are detachably affixed to the body. The body includes a grasping aperture, a first aperture and a second aperture. The grasping aperture allows a user to firmly and comfortably grasp the handle body so as to permit the pouring or movement of the affixed beverage container. The first and second apertures each receive an adjustable container strap. The adjustable container straps are placed about the outer circumference of the beverage container and detained by a securing mechanism. The securing mechanism may be one of a variety of securing devices, including hook and loop material, snap fasteners, button snaps, buttons or buckles.

12 Claims, 3 Drawing Sheets

ADJUSTABLE POURING HANDLE

RELATED APPLICATIONS

The present invention was first described in Disclosure Document Registration 516,310 filed on Aug. 13, 2002 under 35 U.S.C. §122,37 C.F.R. §1.14 and MPEP §1706. There are no previously filed, nor currently any co-pending applications, anywhere in the world.

BACKGROUND OF THE INVENTION

1. Field of the Invention

The present invention relates generally to an adjustable pouring handle for beverage containers and the like and, more particularly, to a handled, container pouring apparatus having an adjustable upper locking portion and an adjustable body support portion for firmly gripping beverage containers of various geometric designs.

2. Description of the Related Art

Plastics, more than any other material, have revolutionized our lives and are used in the vast majority of products we encounter on a daily basis. Included in this category are the disposable drink containers that come in sizes of one-, two- and three-liters, among many others. A common problem exists, however, in that these containers are difficult to grasp by persons with smaller hands, and especially children. Additionally, persons with weak grips, like the elderly or the disabled, cannot compensate for the weight of the container, especially when the container is full. Frequently, and especially with the larger two- and three-liter bottles, the result is often that of spilling the contents or dropping the bottle. This same problem exists for cardboard half-gallon cartons and other large cartons as well.

A search of the prior art did not disclose any patents that read directly on the claims of the instant invention; however, the following references were considered related:

U.S. Pat. No. 6,237,818, issued in the name of Kline, discloses a flexible pouring spout for material containers having a tamper-evident ring and a nested flexible spout moveable between a nested and an extended orientation;

U.S. Pat. No. 6,135,310, issued in the name of Svehang, discloses a combination paint brush holder and a paint pouring unit having a handle for lifting a paint bucket and an annular neck with a pouring spout;

U.S. Pat. No. 6,105,831, issued in the name of Finezilber, discloses a pitcher-style reusable bottle holder threadably attached to a threaded bottle neck and having a downwardly flared handle and a horizontally oriented spout that is sealed by the bottle cap;

U.S. Pat. No. 5,934,296, issued in the name of Clay, discloses a liquid applicator having a curved and hollow neck with threads at the base for threadably securing the applicator to a threaded bottle, wherein the applicator receives liquid through the neck and discharges the received liquid through the sponge head;

U.S. Pat. No. 5,353,819, issued in the name of Kahn et al., discloses a lotion wand for dispensing sunscreen or suntan lotion through a squeezable bottle having a neck, wherein the wand includes a sized cap, a linearly elongated hollow tube vertically extending fom the cap and terminating at an applicator sponge;

U.S. Pat. No. 5,104,010, issued in the name of Codorniz et al., discloses a container pouring apparatus having a generally conical shape and threadably receiving a beverage container for a secure impingement fit;

U.S. Pat. No. 5,104,010, issued in the name of Codorniz et al., discloses a container pouring apparatus having a generally conical shape and threadably receiving a beverage container for a secure impingement fit;

U.S. Pat. No. 4,768,403, issued in the name of Bar-Noy, discloses a combination device acting as a twist-off opener and a handle for attachment to a bottle neck for pouring the contents therefrom, wherein the device has two arms with semi-circular apertures for reciept of the bottle neck, a pivoting pin for allowing the arms to pivot inward and outward, and a handle for grasping;

U.S. Pat. No. 4,660,876, issued in the name of Welding et al., discloses a reusable bottle holder for beverage containers having an annular neck snap fit to accommodate a beverage container neck, a rigid handle and a beverage container body; and U.S. Pat. No. 4,379,578, issued in the name of Schuler, discloses a reusable bottle holder having a locking portion adapted to cooperate in a friction fit manner with a flanged projection found in the nek of a soft drink bottle;

Consequently, a need has arisen for a solution to this problem that allows for easy gripping of the aforementioned containers.

SUMMARY OF THE INVENTION

It is therefore an object of the present invention to provide an improved adjustable pouring handle for beverage containers.

It is a feature of the present invention to provide an improved pouring apparatus having an adjustable upper locking portion and an adjustable body support portion for firmly gripping beverage containers of various geometric designs.

Briefly described according to one embodiment of the present invention, an adjustable pouring handle provides the user with a handle by which to grasp a conventional one-, two- or three-liter beverage bottles, two-gallon cartons, and other similarly configured containers, essentially transforming them into a pitcher. The invention consists of a heavy plastic handle, with a non-slip coating, and two elastic straps with hook and loop fastener, such as VELCRO™. The straps are threaded through two holes in the handle, gripping the container near the top and the bottom. Such a fastening system allows quick application and removal of the apparatus to a container, allowing it be reused in seconds. Once in place, the bottle can be held by the handle and poured in a manner similar to that of a typical beverage pitcher.

The use of the adjustable pouring handle, provides for an easy and steady grip on clumsy, large plastic and/or cardboard containers in a manner which prevents dropping and spillage.

Further, the present invention: provides a temporary handle for large one-, two-, or three-liter disposable plastic bottles, two-gallon containers and the like; allows for a firm grasp; prevents dropping/spillage; is easy to use by children, elderly, or the disabled; and may be transferred from empty bottles to full bottles in a quick fashion.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1–4.

1. Detailed Description of the Figures

Referring now to FIG. 1 through FIG. 4, an adjustable pouring handle 10 is shown in accordance with the preferred embodiment of the present invention. The adjustable pouring handle 10 includes a linearly elongated body 12 having a pair of adjustable container straps 14 and 16. The pair of adjustable container straps 14 and 16 are detachably affixed to the linearly elongated body 12.

Figure 1:
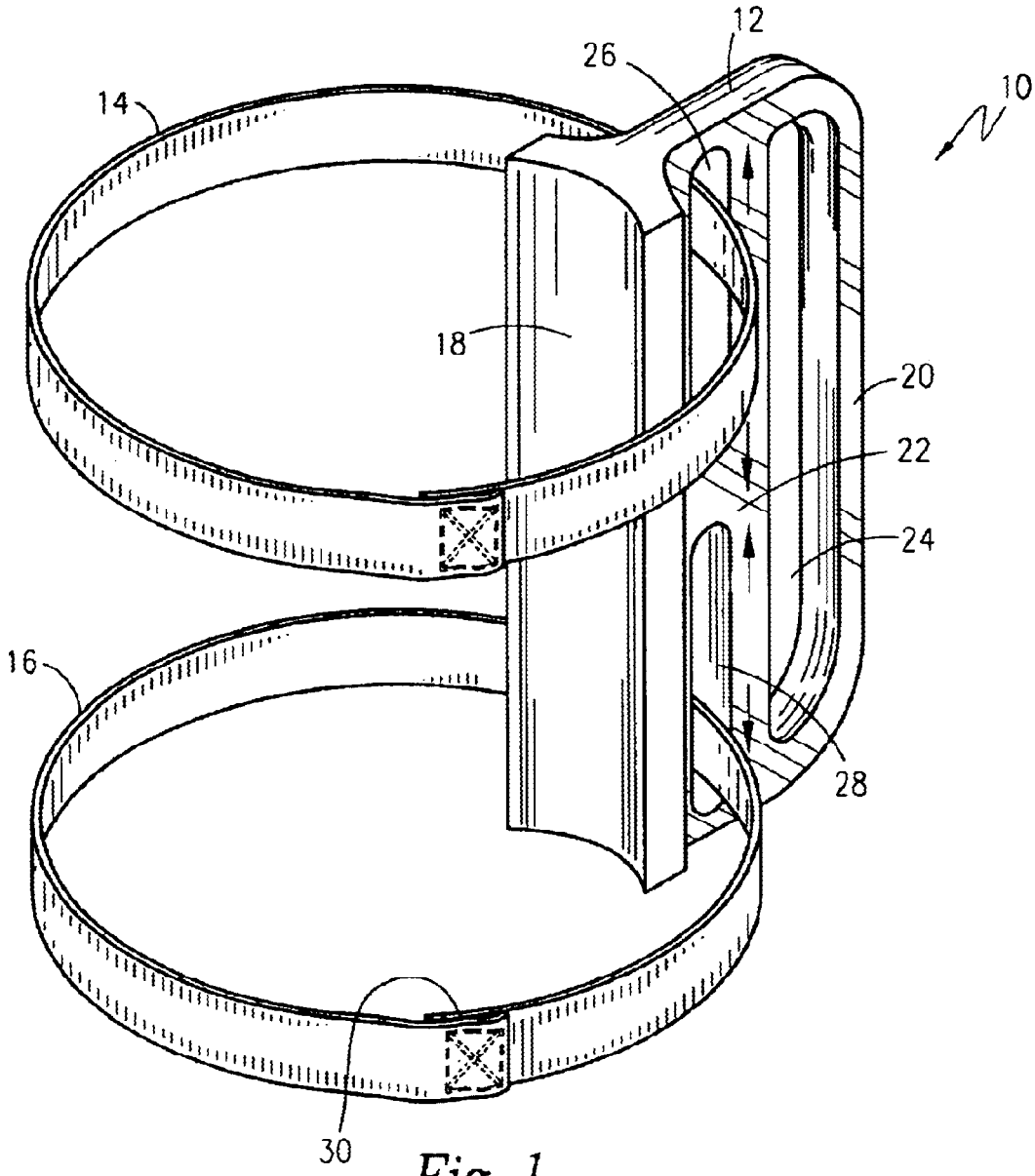
FIG. 1 is a perspective view of an adjustable pouring handle, having a body with a grasping handle, a first aperture for receiving a container strap, a second aperture for receiving a second container strap, and a surface area along the anterior surface of the body for securing the adjustable pouring handle against the outer circumference of the body.
Figure 2:
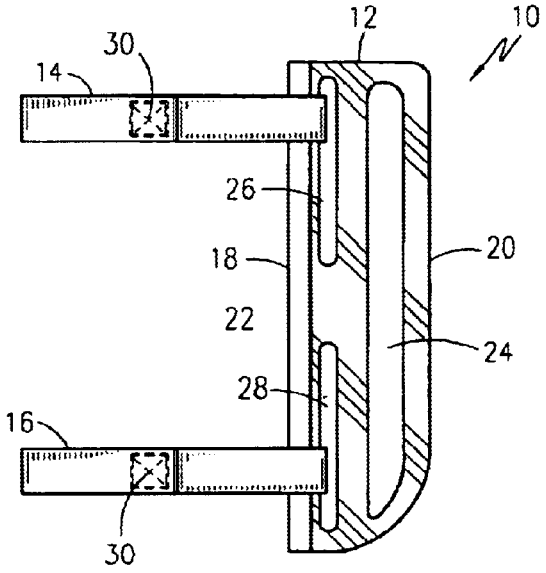
FIG. 2 is a side view of the adjustable pouring handle.
Figure 3A:
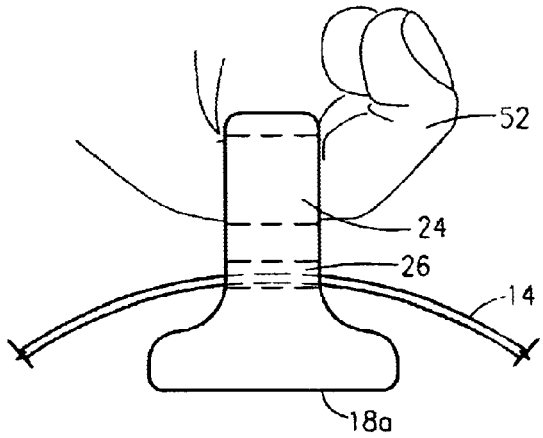
FIG. 3*a* is a top view of the body of the adjustable pouring handle, illustrating the flattened anterior surface, the grasping aperture and the first or second aperture in phantom, and a user hand grasping the body for pouring or moving.
Figure 3B:
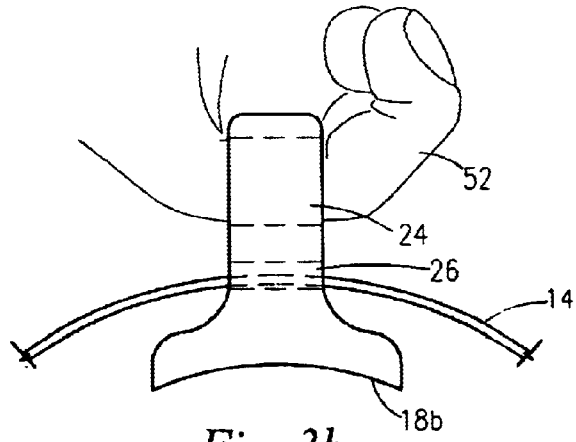
FIG. 3*b* is a top view of the body of the adjustable pouring handle, illustrating the curvilinear anterior surface, the grasping aperture and the first or second aperture in phantom, and a user hand grasping the body for pouring or moving.
Figure 4:
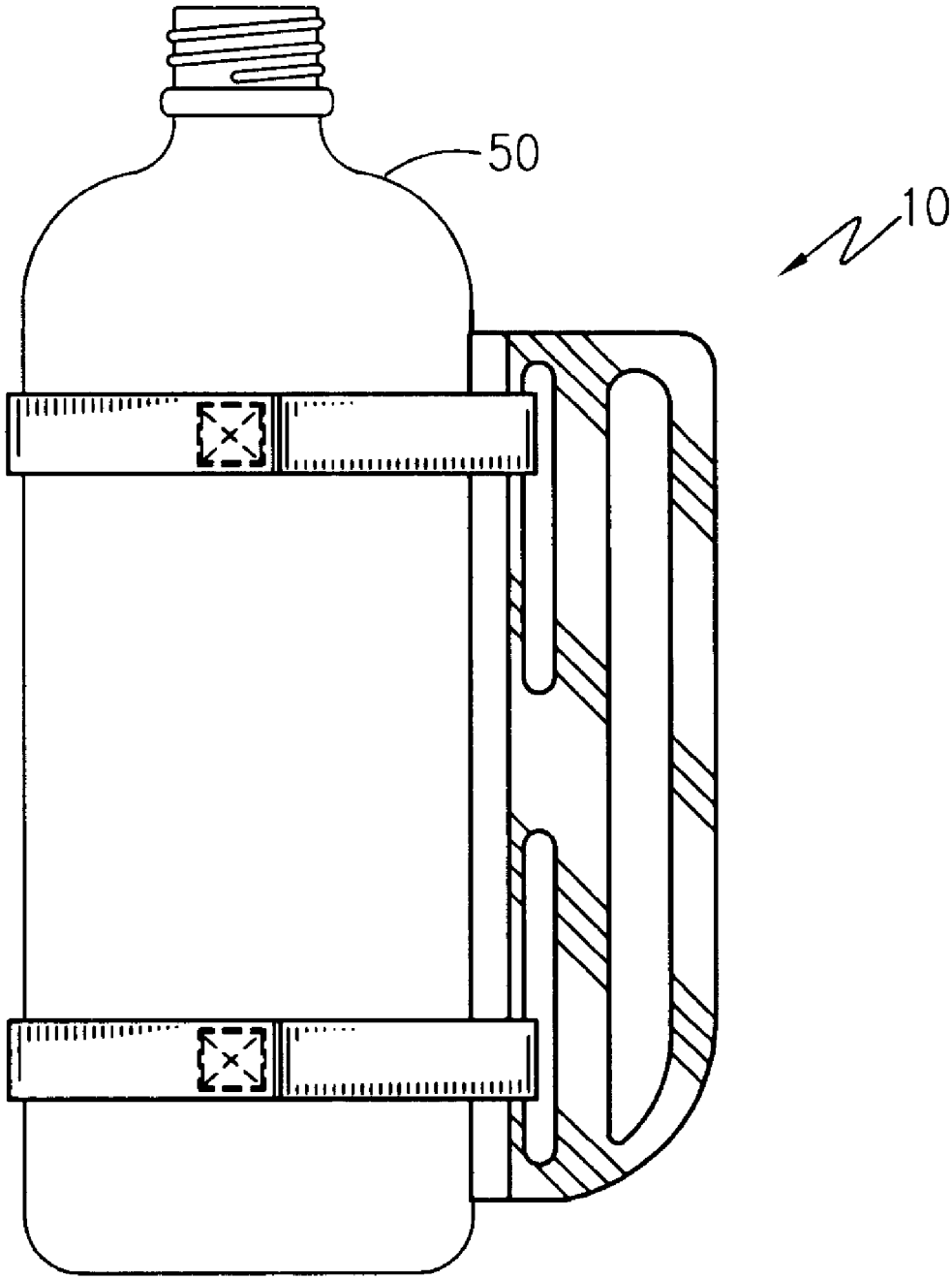
FIG. 4 is an elevational view of the adjustable pouring handle affixed to a beverage container.

The body 12 includes a linearly elongated anterior surface 18, a curvilinear posterior surface 20 and an internal panel 22. The anterior surface 18 abuts against the outer surface of the beverage container 50 to which the adjustable pouring handle 10 is secured. The flattened nature of the anterior surface 18*a* provides a greater surface area for the adjustable pouring handle 10 to contact the beverage container 50, thereby providing greater stability to the adjustable pouring handle 10 when affixed to the beverage container 50 and enabling a user to safely and securely use the adjustable pouring handle 10. Optionally, the anterior surface 18*b* may provide a curvilinear surface (as depicted in FIG. 3*b*), thereby providing a more secure fit and greater surface area contact when the adjustable pouring handle 10 is affixed to a cylindrical beverage container 50. The curvilinear posterior surface 20 provides a comfortable handling surface for user's hand 52. The internal panel 22 includes a grasping aperture 24, a first aperture 26 and a second aperture 28. The grasping aperture 24 substantially transverses a vertical length of the body 12, thereby providing a variety of grasping points to a user through which the user's fingers may comfortably fit therethrough. The grasping aperture 24 lies adjacent to and runs parallel with the curvilinear posterior surface 20, thereby working in conjunction with the posterior surface 20 to provide optimal hand comfort to the user. The first aperture 26 lies adjacent to and runs parallel with the anterior surface 18. The first aperture 26 transverses less than half of the vertical length of the linearly elognated body 12. The first aperture 26 receives one of the pair of adjustable straps 14 or 16. The second aperture 28 lies adjacent to and runs parallel with the anterior surface 18, and further lies opposite to the first aperture 26. The second aperture 28 transverses less than half of the vertical length of the linearly elongated body 12. The second aperture 28 receives one of the pair of adjustable straps 14 or 16. In combination, the first aperture 26 and the second aperture 28 transverse a substantial length of the body 12, thereby providing the adjustable pouring handle 10 with the adaptability to elevate or lower each respective strap 14 or 16, thereby accommodating a variety of heights of beverage containers 50.

The pair of adjustable container straps 14 and 16 includes a first adjustable container strap 14 and a second adjustable container strap 16. For illustrative purposes only, and not limiting the scope of the present invention, the first adjustable container strap 14 is affixed to the body 12 via the first aperture 26. The second adjustable container strap 16 is affixed to the body 12 via the second aperture 28. However, it is envisioned that the first adjustable container strap 14 and the second adjustable container strap 16 may be reversed so that the first adjustable container strap 14 is affixed to the body 12 via the second aperture 28, and the second adjustable container strap 16 is affixed to the body 12 via the first aperture 26. The first adjustable container strap 14 and the second adjustable container strap 16 may include a variety of securing mechanisms, include hook and loop material 30, button snaps, snap fasteners, buttons or buckles. The first adjustable container strap 14 and the second adjustable container strap 16 is depicted as hook and loop material 30, thereby providing optimum power for securely gripping and maintaining the hold of the adjustable pouring handle 10 when attached to a beverage container 50.

The adjustable pouring handle 10 is envisioned to be available in a variety of colors and materials. The adjustable pouring handle 10 may be manufactured from plastic, metal or other lightweight and. durable materials.

2. Operation of the Preferred Embodiment

To use the present invention, a user will release the first adjustable container strap 14 and the second adjustable container strap 16 so that a beverage container 50 may be received therebetween. The user will then fasten either the first or second adjustable container strap 14 or 16, firmly tightening the strap 14 or 16 about the outer surface of the beverage container 50. After tightening the strap 14 or 16 to the desired tautness, the remaining strap 14 or 16 is fastened about the outer circumferential surface of the beverage container 50 until reaching the desired tautness. Once the two straps 14 and 16 are firmly tightened, the user may grasp the adjustable pouring handle 10 by the grasping aperture 24 near the posterior surface 20 of the body 12 and either carry or pour the contents of the beverage container 50.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. An adjustable pouring handle comprising:

a linearly elongated body for abutting a beverage container, said body having a grasping aperture, and a first aperture superior to a second aperture, wherein said first aperture and said second aperture each traverse slightly less than half of a vertical length of said body for allowing selective raising and lowering of a pair of adjustable container straps and accommodating varying heights of beverage containers; and each one of said pair of adjustable container straps detachably affixed to a corresponding one of said first aperture or said second aperture, said pair of adjustable container straps circumscribing said beverage container.

2. The adjustable pouring handle of claim 1, wherein said body comprises:

a linearly elongated anterior surface for abutting said beverage container;

a curvilinear posterior surface; and an internal panel, said internal panel depending from and intermediate to said anterior surface and said posterior surface.

3. The adjustable pouring handle of claim 2, wherein said anterior surface comprises a flattened surface, said flattened surface abuts against a beverage container.

4. The adjustable pouring handle of claim 2, wherein said anterior surface comprises a curvilinear surface, said curvilinear surface abuts against a beverage container.

5. The adjustable pouring handle of claim 2, wherein said posterior surface comprises a comfortable handling surface for a human hand.

6. The adjustable pouring handle of claim 2, wherein said plurality of apertures comprises:

a grasping aperture, said grasping aperture lying adjacent to said posterior surface;

a first aperture, said first aperture lying adjacent to said anterior surface; and a second aperture, said second aperture lying adjacent to said anterior surface and opposite to said first aperture.

7. The adjustable pouring handle of claim 6, wherein said grasping aperture runs parallel to said posterior surface.

8. The adjustable pouring handle of claim 7, wherein said grasping aperture substantially transverses a vertical length of said body, said grasping aperture providing a plurality of grasping positions for a human hand.

9. The adjustable pouring handle of claim 6, wherein said first aperture runs parallel to said anterior surface.

10. The adjustable pouring handle of claim 6, wherein said second aperture runs parallel to said anterior surface.

11. The adjustable pouring handle of claim 1, wherein said pair of adjustable container straps comprises:

a first adjustable container strap, said first adjustable container strap comprising a detachable securing mechanism; and a second adjustable container strap, said second adjustable container strap comprising a detachable securing mechanism.

12. The adjustable pouring handle of claim 11, wherein said securing mechanism is selected from the group consisting of hook and loop material, button snaps, snap fasteners, buttons and buckles.

* * * * *